US006293261B1

(12) United States Patent
Oemcke et al.

(10) Patent No.: US 6,293,261 B1
(45) Date of Patent: Sep. 25, 2001

(54) CANISTER PURGE HYDROCARBON SENSING

(75) Inventors: Jonathan M. Oemcke, Rochester; Susan Scott Labine, Avon; Robert Thomas Cook, Rush, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/518,401

(22) Filed: Mar. 3, 2000

(51) Int. Cl.[7] ..... F02M 33/02
(52) U.S. Cl. ..... 123/520; 123/516
(58) Field of Search ..... 123/520, 516, 123/517, 518, 519; 60/283, 285

(56) References Cited

U.S. PATENT DOCUMENTS

| | | | | |
|---|---|---|---|---|
| H454 | | 4/1988 | Sickenberger et al. | 73/27 R |
| 3,045,198 | | 7/1962 | Dolan et al. | 338/13 |
| 4,224,595 | | 9/1980 | Dolan | 338/34 |
| 4,237,721 | | 12/1980 | Dolan | 73/23 |
| 4,827,246 | | 5/1989 | Dolan et al. | 340/521 |
| 4,935,726 | | 6/1990 | Buro et al. | 340/603 |
| 5,202,667 | | 4/1993 | Alvin | 340/604 |
| 5,245,975 | * | 9/1993 | Ito | 123/520 |
| 5,408,976 | * | 4/1995 | Reddy | 123/519 |
| 5,596,972 | * | 1/1997 | Sultan et al. | 123/520 |
| 5,873,352 | * | 2/1999 | Kidokoro et al. | 123/520 |
| 5,913,343 | | 6/1999 | Andersson | 114/59 |
| 5,944,067 | | 8/1999 | Andersson | 141/59 |
| 5,957,113 | * | 9/1999 | Masaki et al. | 123/518 |

* cited by examiner

*Primary Examiner*—Henry C. Yuen
*Assistant Examiner*—Mahmoud Gimie
(74) *Attorney, Agent, or Firm*—Vincent A. Cichosz

(57) ABSTRACT

Purging of a fuel vapor storage canister of an internal combustion engine is optimized through the provision of fuel vapor storage apparatus. A real time measurement of the fuel vapor content of the canister is enabled by providing the canister with a fuel vapor sensor located in at least one of the purge line and the fresh air port of the canister. The fuel vapor sensor is most preferably an adsorption sensitive resistor which operates on the principle of adsorption according to Vander Walls "a" constant, and the electrical resistance of the fuel vapor sensor preferably varies with respect to the fuel vapor concentration present.

16 Claims, 10 Drawing Sheets

CANISTER PURGE HYDROCARBON SENSING

FIELD OF THE INVENTION

The present invention relates in general to the reduction of pollutant emissions during the operation of an internal combustion engine.

BACKGROUND OF THE INVENTION

Modern vehicles which are powered by an internal combustion engine utilize a number of techniques and technologies in order to significantly reduce pollutant emissions. For example, so-called "tailpipe" emissions are typically reduced by: 1) monitoring the oxygen content of the exhaust gas (e.g., via an oxygen sensor mounted in the exhaust path of the engine) and adjusting the air to fuel ratio introduced into the engine; and 2) passing the exhaust gases of the internal combustion process through a catalytic converter prior to releasing them into the ambient atmosphere.

However, another manner in which internal combustion powered vehicles produce pollutants is through the evaporation of fuel, for example, from the fuel supply tank (or "gas tank") of the vehicle. Regulations continue to reduce the allowable limits of such "evaporative emissions". One widely used method of reducing evaporative emissions from vehicles is to provide a fuel vapor storage canister for storing evaporated fuel vapor. Such a canister normally includes a carbon-based component which traps and stores the hydrocarbon vapor. The canister is typically "purged" during engine operation, meaning that the fuel vapor stored in the canister is transferred to a fuel intake portion of the engine (e.g., the intake manifold or throttle body) and is thus internally combusted by the engine as a portion of its fuel consumption.

Determining exactly when the canister should be purged and at what rate can be problematic. Since any purging of the canister involves the supply of additional fuel to the engine, ideally, compensation should be made to the rate at which fuel is fed directly to the engine from the fuel tank. If the engine has been idle (e.g., following a startup of the engine after extended parking of the vehicle), it may be expected that the canister will have accumulated some degree of fuel vapor content. The vapor content of the canister is really determined, to a great extent, by the ambient conditions of the vehicle, such as ambient temperature, ambient pressure, particular fuel mixture, etc.

Following engine startup, the canister is normally purged to some degree. Purging is not, however, usually initiated immediately upon startup, but only after the engine has entered a "closed loop" mode of operation. The oxygen sensor which is located in the exhaust path and which is used, along with other factors, to determine the fuel forward feed ratio of the engine does not normally provide accurate readings until it has reached an elevated temperature. Before this point, the engine is typically operated in an "open loop" mode of operation, wherein the appropriate air to fuel ratio of the engine is approximated, e.g., by software provided as read only memory within an "Engine Control Module" (or "ECM"), which is typically a microprocessor.

Once the engine enters a closed loop mode of operation, where the readings from the oxygen sensor are considered sufficiently reliable, software algorithms are also normally employed to control the fuel flow to the engine based upon readings of the oxygen sensor located in the exhaust path of the engine.

During purging of the canister, fuel vapor stored therein is transferred to the fuel intake portion of the engine through a purge line connecting the canister to the engine. In many modern vehicles, flow through the purge line is controlled using a "purge solenoid" located in the purge line. The flow rate from the canister to the engine via the purge line is controlled through modulation of the purge solenoid by the ECM.

It is not only during initial engine startup that the canister is typically purged. Hydrocarbon vapor is continually being produced, to some degree, in the fuel tank and therefore stored in the canister, even during actual operation of the vehicle. As noted above, the rate of production of hydrocarbon vapor in the fuel tank is dependent upon environmental variables such as ambient temperature and pressure which can vary widely and rapidly. The rate of fuel vapor production also vary with respect to commercial fuel mixtures (e.g., summer, winter, etc.).

With allowable levels of evaporative emissions being reduced, the trend is toward increasing purge line flow in order to reduce evaporative emissions. A positive flow from the canister to the engine may exist during a majority of the time the vehicle is being operated.

The software algorithms discussed above attempt to determine an appropriate purge flow rate based upon variables such as ambient temperature, time of engine operation, etc. They attempt to estimate the fuel vapor content of the canister and appropriate purge flow rates and can be difficult to calibrate. That is, such software algorithms do not employ any real time determination of the actual fuel vapor content of the canister. Any adjustment which is made to the normal fuel feed rate to compensate for the fuel vapor fed to the engine through the purge line is therefore an approximation of actual conditions.

A continuous purging of the canister, or an over purging of the canister, can cause the canister to become contaminated, thereby reducing its efficiency and/or shortening its service life. A typical storage canister is provided with a fresh air port. During purging, air from the ambient environment enters the canister through the fresh air port replacing the flow of fuel vapor supplied to the engine through the purge line. Such "fresh air" can contain slush, salt, dirt, and all of the various contaminants to which modern vehicles are subjected. Such contaminants can seriously diminish the efficiency and service life of the canister.

The phenomenon of "canister breakthrough" is also a factor which can increase evaporative emissions from a vehicle. Depending upon environmental conditions and the size of a particular canister, a saturation of the canister may cause a spillover of fuel vapor into the ambient environment, and thus defeat the intended purpose of the canister.

In view of the above considerations, it will be appreciated that the purge flow should be sufficient to prevent canister breakthrough, an actual determination of the rate at which fuel vapor is being fed to the engine through the purge line allows for a more accurate compensation in the fuel equation of the engine, and the canister should not be excessively purged which can reduce its efficiency.

OBJECTIVES OF THE INVENTION

One objective of the present invention is the provision of a fuel vapor storage apparatus for an internal combustion engine including a fuel vapor storage canister which enables an actual real time determination to be made of the fuel vapor content of the canister.

Another objective of the invention is the provision of such a fuel vapor storage apparatus which enables a more accurate compensation to be made in the fuel equation of the engine for fuel vapor introduced into the engine through the purge line.

A further objective of the invention is the provision of such a fuel vapor storage apparatus which enables an optimization of the rate of purge flow from the canister.

Yet another objective of the invention is the provision of such a fuel vapor storage apparatus which can detect and substantially prevent canister breakthrough.

A still further objective of the invention is the provision of such a fuel vapor storage apparatus which can maintain the efficiency of the canister by preventing excessive purging thereof.

SUMMARY OF THE INVENTION

In one aspect, the invention generally features a fuel vapor storage apparatus for reducing pollutant emissions from an internal combustion engine having a fuel tank. The fuel vapor storage apparatus includes a fuel vapor storage canister for storing fuel vapor produced by evaporation of fuel stored in the fuel tank, a purge line connecting the fuel vapor storage canister with the internal combustion engine, a fresh air port connecting an interior portion of the fuel vapor storage canister with an ambient atmosphere of the internal combustion engine, and a fuel vapor sensor for determining a concentration of fuel vapor. The fuel vapor sensor is disposed so as to measure a fuel vapor concentration in at least one of the purge line and the fresh air port.

In another aspect, the invention generally features a method for controlling the purging of a fuel vapor storage canister of an internal combustion engine which has a fuel tank. The fuel vapor storage canister is provided for the storage of fuel vapor produced by evaporation of fuel stored in the fuel tank and has a purge line for purging fuel vapor from the fuel vapor storage canister to the internal combustion engine during the purging and a fresh air port for admitting ambient air into the fuel vapor canister during the purging. The method includes the steps of (a) determining a concentration of fuel vapor existing in at least one of the purge line and the fresh air port and (b) controlling a rate of flow of fuel vapor through the purge line from the fuel vapor storage canister to the internal combustion engine based upon the concentration of fuel vapor determined in step (a).

The invention will now be described by way of a number of particularly preferred embodiments, after first briefly describing the drawings, wherein:

DETAILED DESCRIPTION OF THE PREFERRED EMBODIMENTS

Figure 1:
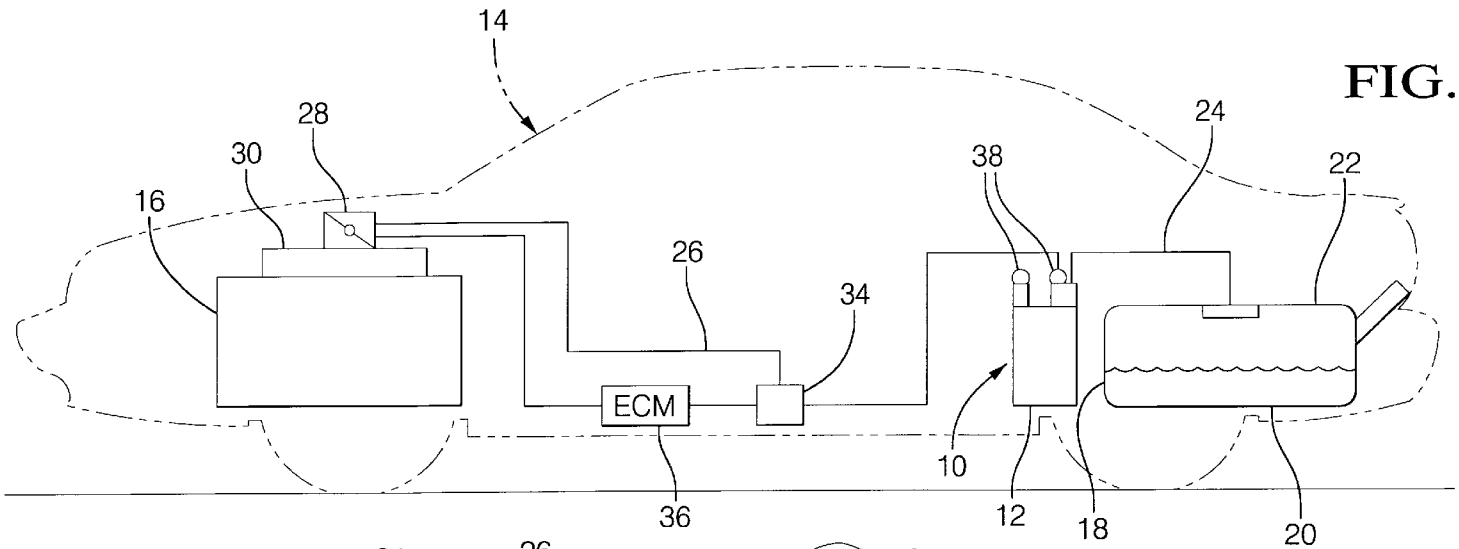
FIG. 1 is a diagrammatic view of a vehicle equipped with a fuel vapor storage apparatus constructed according to the present invention.

Prior to proceeding to a much more detailed description of the present invention, it should be noted that identical components which have identical functions have been identified with identical reference numerals throughout the several views illustrated in the drawing figures for the sake of clarity and understanding of the invention.

Figure 2:
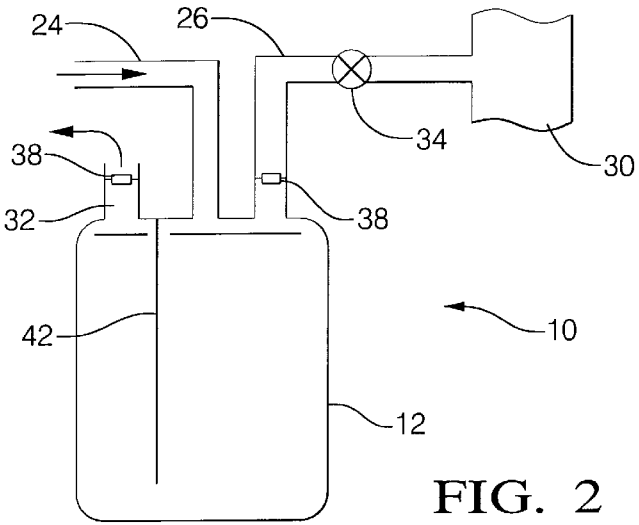
FIG. 2 is a diagrammatic view of the fuel vapor storage apparatus and having an inset slowing an enlarged detail of a fuel vapor sensor employed in the invention.
Figure 3:
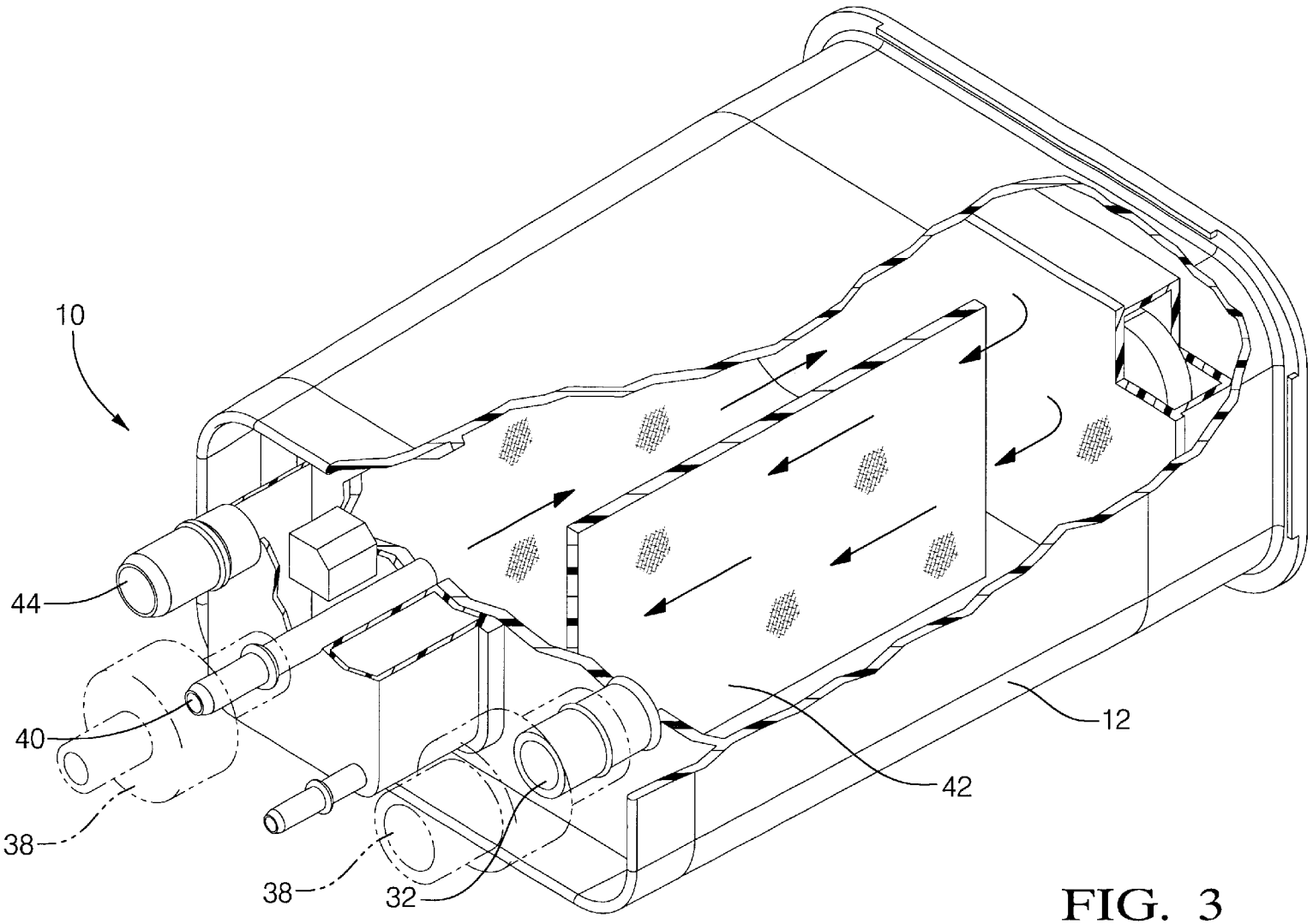
FIG. 3 is a perspective view of the fuel vapor storage apparatus.
Figure 4:
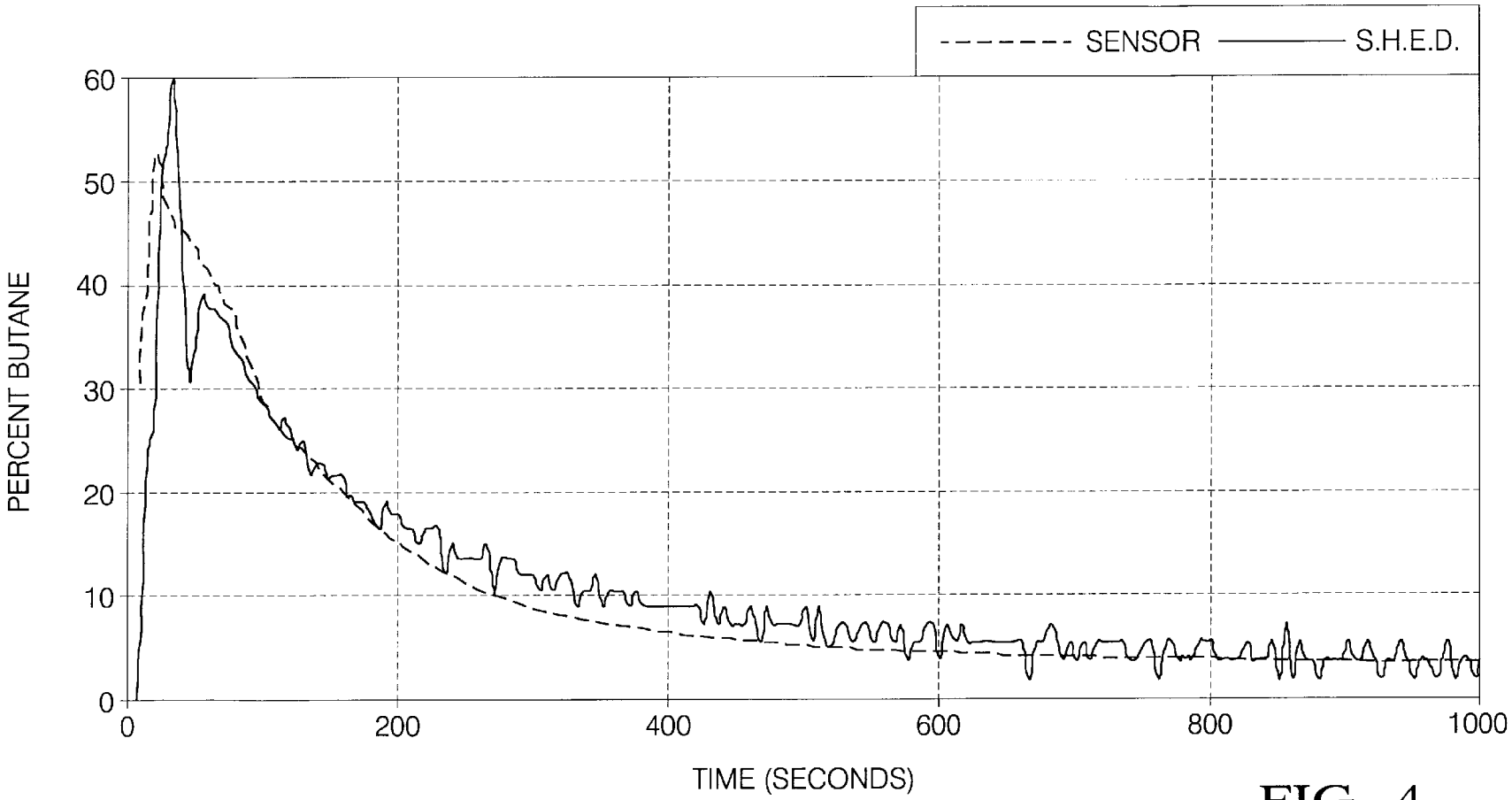
FIG. 4–11 are charts of canister purge flows illustrating a determination of hydrocarbon vapor content as measured by a fuel vapor sensor employed in the present invention, as well as a control hydrocarbon vapor content determined according to the SHED ("Sealed Housing for Evaporative Determination") standard published by the Society of Automotive Engineering ("SAE").
Figure 5:
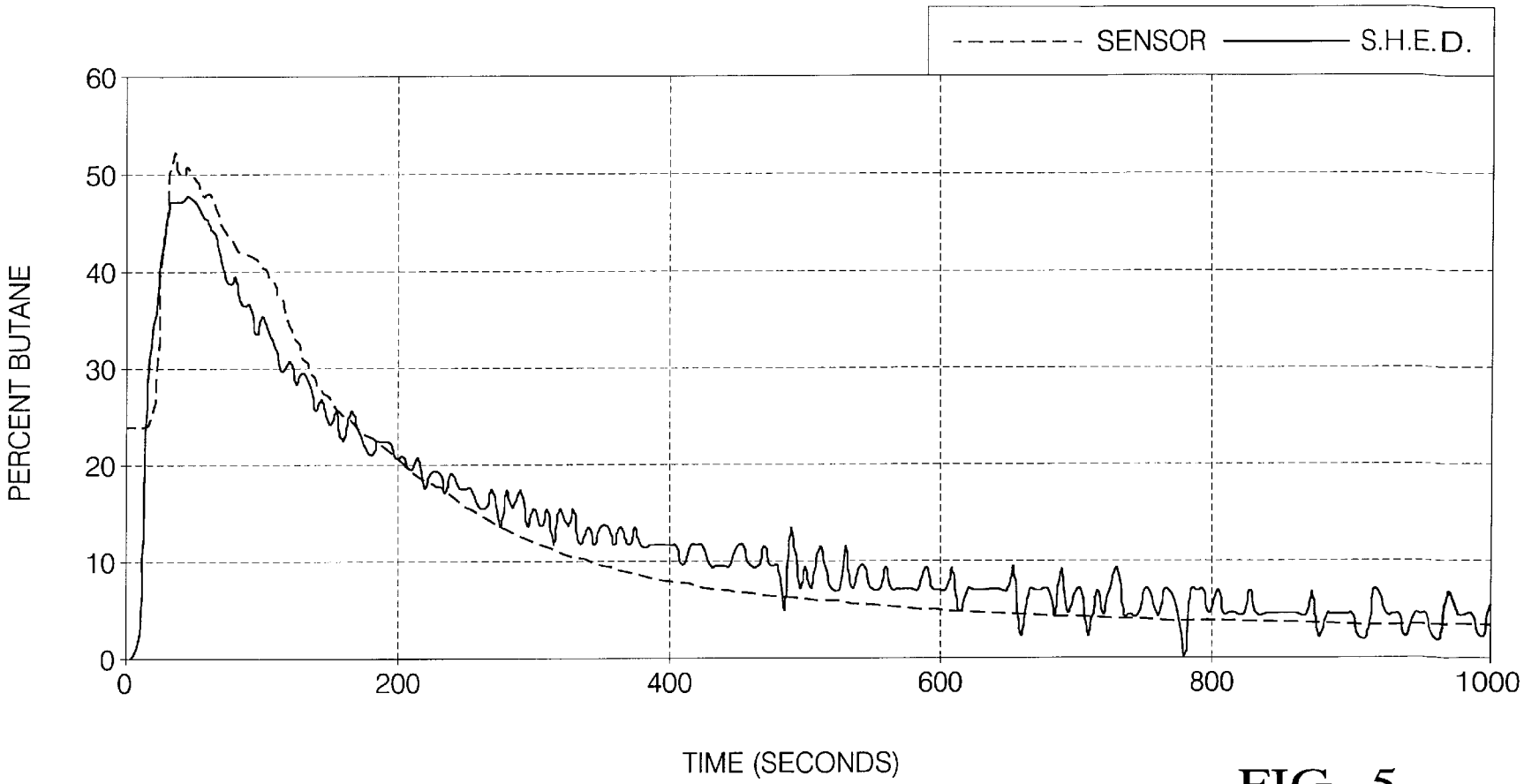
Figure 6:
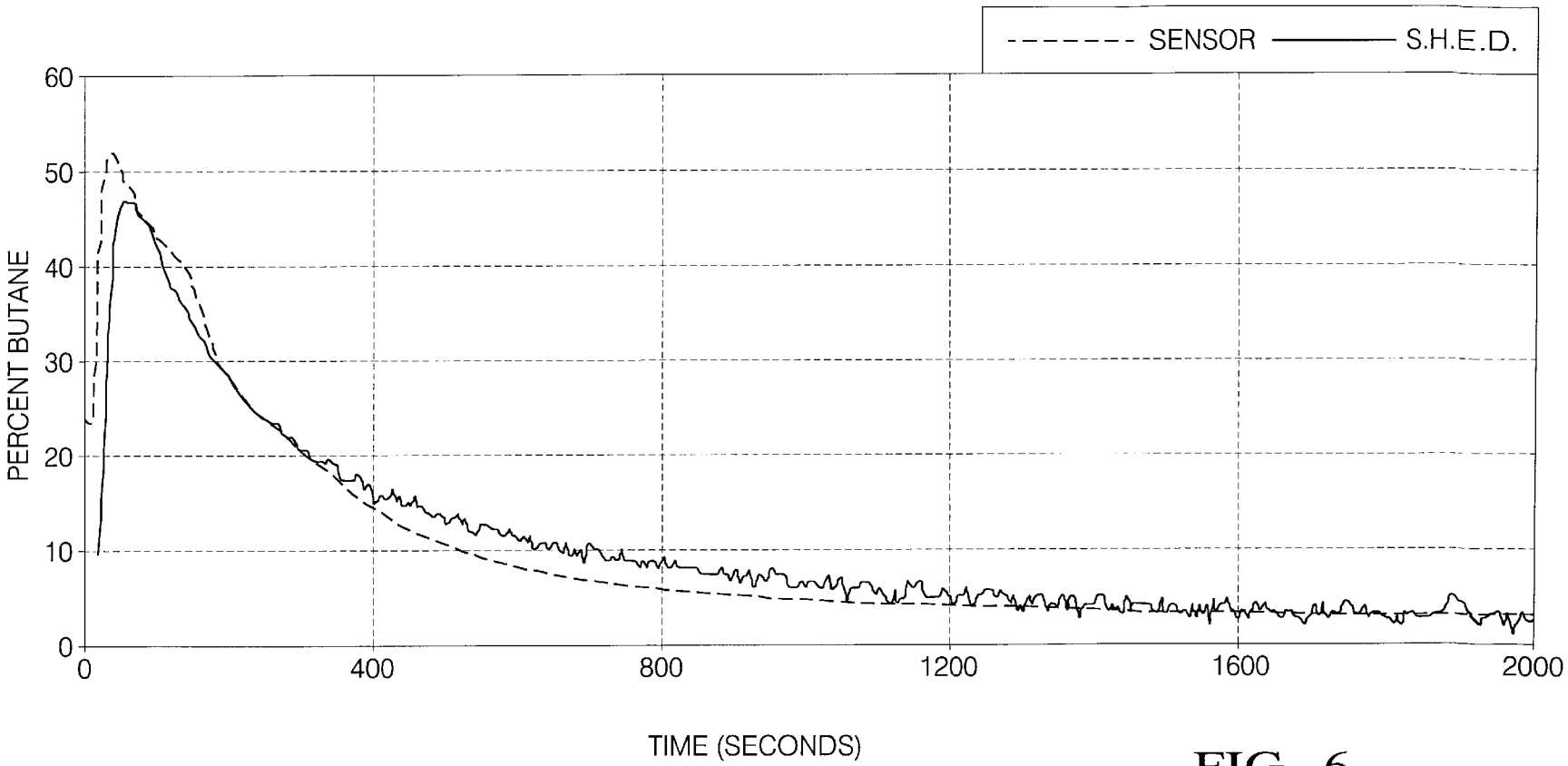
Figure 7:
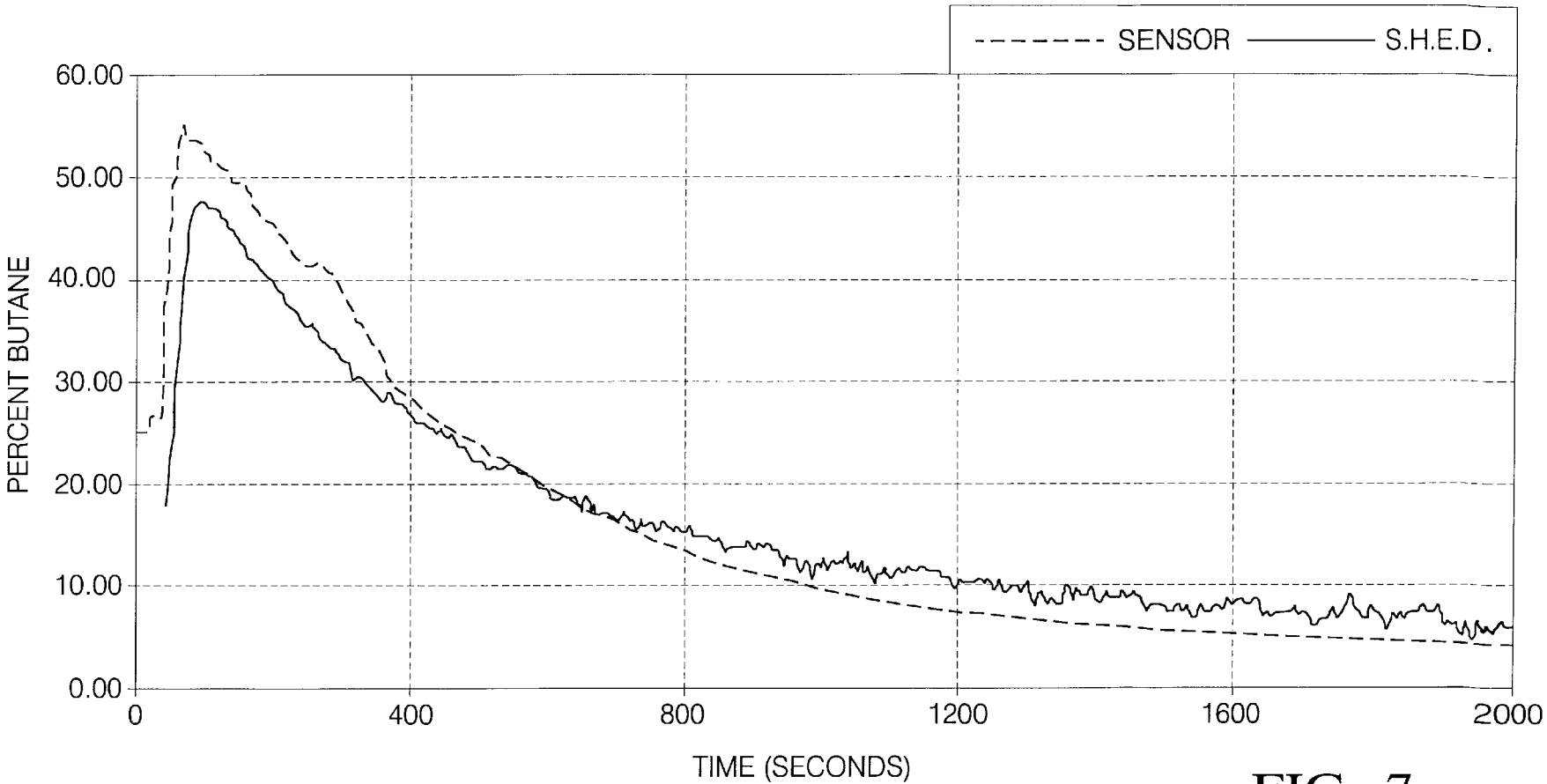
Figure 8:
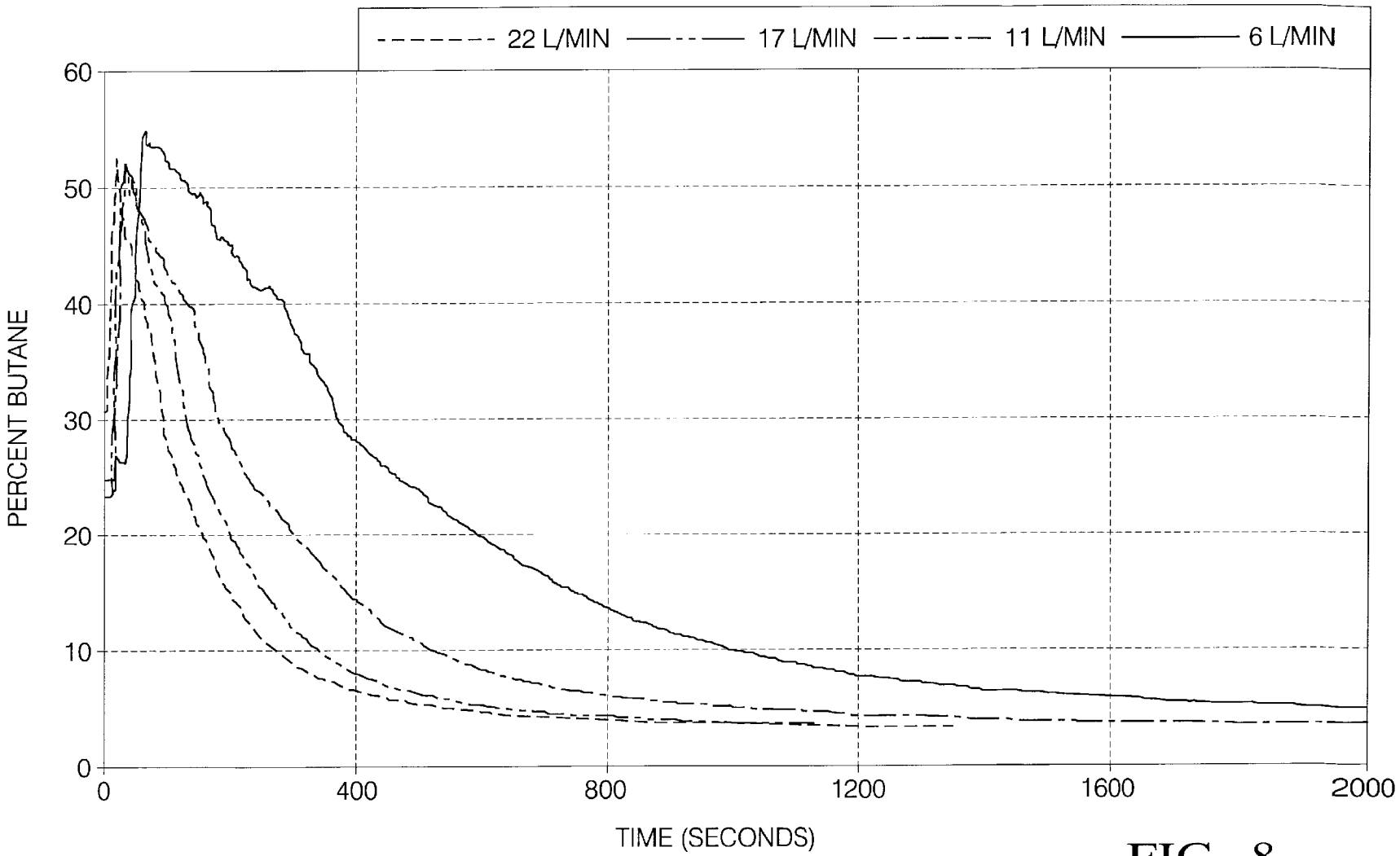
Figure 9:
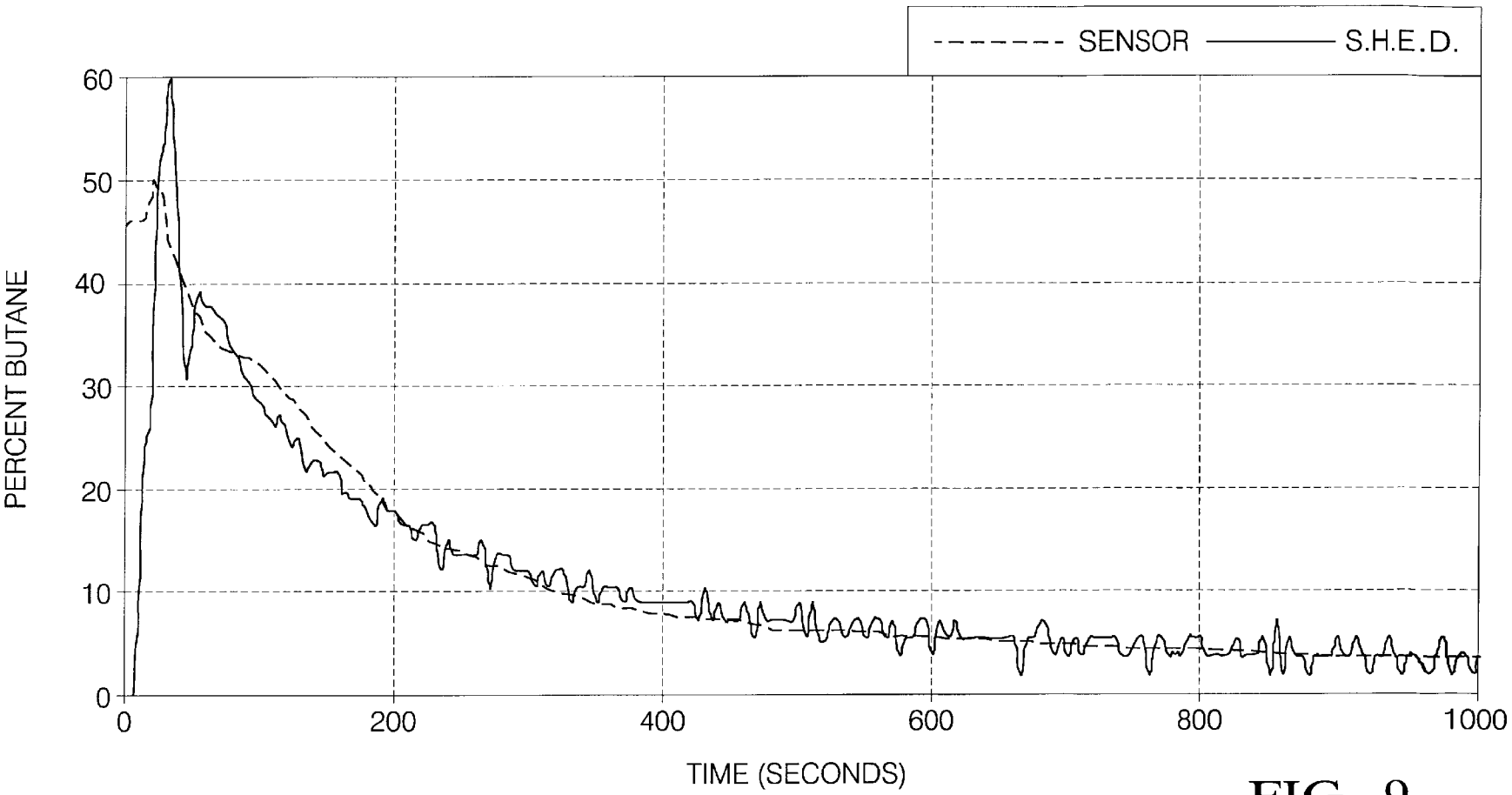
Figure 10:
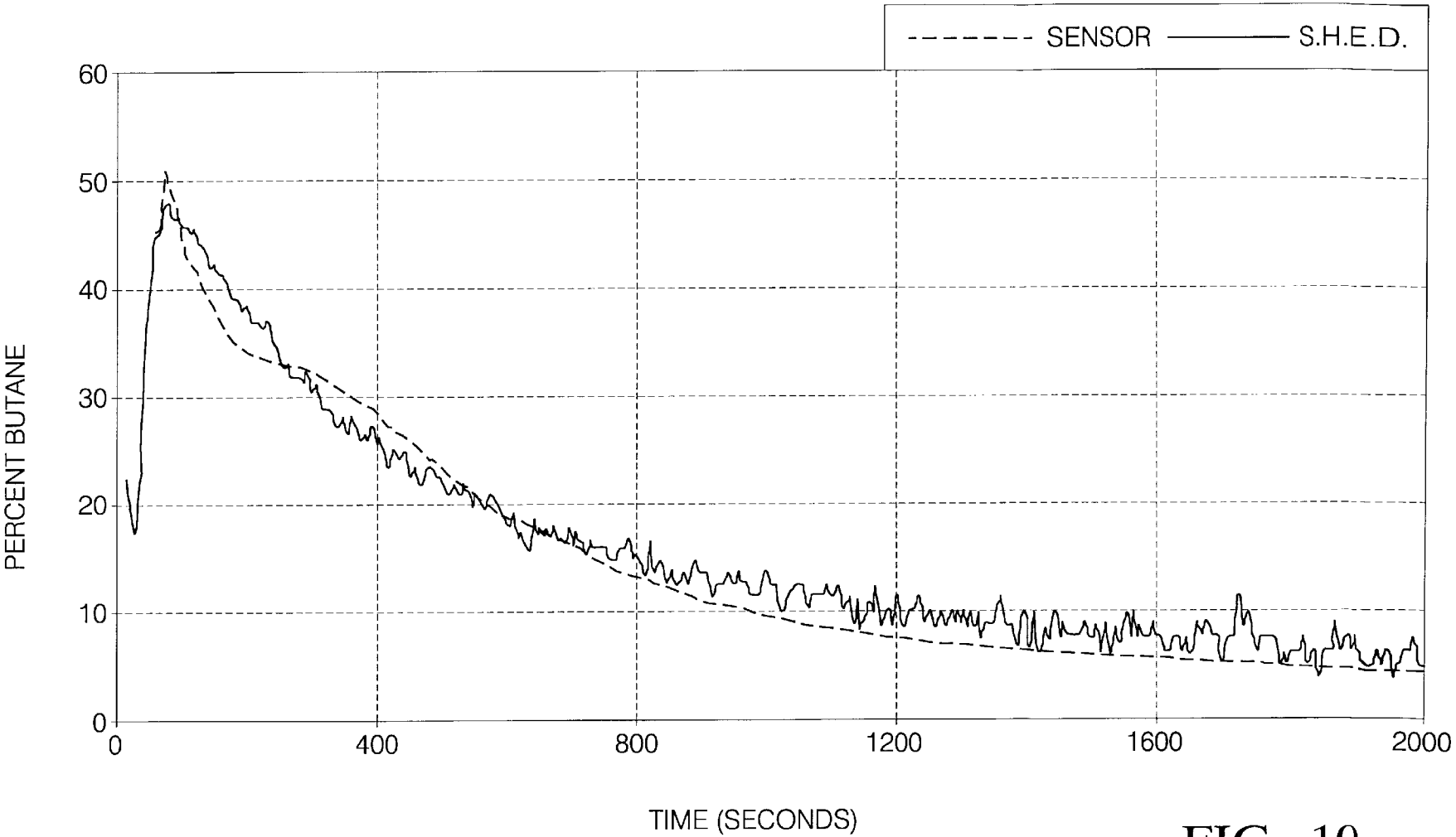

Referring initially most particularly to FIGS. 1–3, a fuel vapor storage apparatus according to the present invention generally designated by reference numeral 10 and includes a fuel vapor storage canister 12. The canister 12 is preferably of a carbon canister type which is well known in the automotive arts for use in trapping and storing hydrocarbon vapors. The canister 12 will, in general, usually be provided on a vehicle 14 which is powered by an internal combustion engine 16, both of which are shown only in a diagrammatic fashion and not to scale in FIG. 1. A fuel tank 18 holds a supply of fuel 20 (e.g., gasoline) for the engine 16. The fuel tank 18 of the vehicle 14 is refueled via a filler spout 22. Fuel vapor is produced through evaporation of the fuel 20. The fuel vapor is transferred through a fuel tank vent line 24 into the interior of the canister 12. The fuel vapor entering the canister 12 is trapped and stored there, as is well understood, by a typically carbon based material contained in the canister 12. At some point during the operation of the engine 16, normally only after the engine 16 has reached a closed loop mode of operation, the canister 12 is "purged" by transferring the fuel vapor stored therein to a fuel intake portion of the engine (e.g., an intake manifold, a throttle body, etc.). As the canister 12 is purged, the fuel vapor transferred from the canister 12 is internally combusted as a portion of the fuel supplied to the engine 16. To this end, the canister 12 and the engine 16 are connected by a purge line 26 which, in the depicted embodiment, leads from the canister 12 to a throttle body 28 connected to an intake manifold 30 of the engine 16. Flow through the purge line 26, from the canister 12 to the engine 16 is replaced by ambient air which enters the canister 12 through a fresh air port 32 (seen most clearly in FIGS. 2 and 3) which is provided on the: canister 12.

During operation of the engine 16, a negative pressure is produced in the intake manifold 30 which, if uncontrolled, would produce a continuous flow through the purge line 26, with replacement air entering the canister 12 through the fresh air port 32. Therefore, flow through the purge line 26 is controlled by a purge solenoid 34. The purge solenoid 34, and therefore the rate of vapor flow through the purge line 26, is modulated by an engine control module (or "ECM") 36. The ECM 36 is typically a microprocessor which receives signals from a number of sensors located throughout the vehicle 14 and controls various vehicle processes according to software located in the processor's memory, e.g., ROM, EPROM, etc.

Typically, current vehicles control the flow rate through the purge line 26 via the purge solenoid 34 according to software algorithms (stored in the ECM 34) which attempt to approximate or predict the fuel vapor content of the canister 12 based upon a number of factors such as, for example, elapsed time since startup of the engine 16, ambient temperature, expected fuel mixture, etc. However, such software algorithms are only an approximation of the actual fuel vapor content existing in the canister 12 and the purge line 26. Such software algorithms can be difficult to program and calibrate to account for all of the variables that a modern vehicle can be expected to encounter.

In the present invention, control of the purge solenoid 34 (for example, via the ECM 36) is optimized by providing a fuel vapor sensor 38 which monitors and therefore provides an actual real time reading of the fuel vapor content existing within the canister 12 or the purge line 26. The presently preferred locations of the fuel vapor sensor 38 are such as to permit monitoring and providing real time measurements of fuel vapor content in either or both of the purge line 26 and the fresh air port 32 of the canister. However, the average artisan will appreciate that the fuel vapor sensor 38 may be mounted in other locations in order to provide real time readings of fuel vapor content and thus allow optimized purging of the canister 12.

Referring most particularly to FIG. 3, the canister 12 includes a purge port 40 where the purge line 26 enters the canister 12. The canister 12 will additionally typically include an interior partition 42 and may optionally be provided with a filler port 44 to capture fuel vapor released during onboard refueling.

The presently preferred locations for the fuel vapor sensor 38 according to the present invention are shown in FIGS. 1–3. Most preferably, a fuel vapor sensor 38 is mounted either within or immediately adjacent to one or both of the purge port 40 and the fresh air port 32 of the canister 12. When the fuel vapor sensor 38 is located within or adjacent the purge port 40 of the canister 12, the fuel vapor content of the flow through the purge line 26 can be actually determined.

There are a great number of advantages in determining the actual fuel vapor content of the canister 12. In the case where a fuel vapor sensor 38 is positioned in the purge line 26 (e.g., in the purge port 32 of the canister 12), the fuel equation of the engine 16 can be more accurately compensated to account for the flow of fuel vapor introduced through the purge line 26. This may lead to an increase in fuel control and reduced tailpipe emissions. Additionally, if the fuel vapor content entering the purge line 26 through the purge port 40 of the canister 12 is relatively low, the purge flow rate can be reduced so as to not over purge the canister 12 and introduce excessive contaminants into the canister 12. In the case where a fuel vapor sensor 38 is located at the fresh air port 32 of the canister 12, canister breakthrough (or imminent canister breakthrough) can be sensed, indicating the desirability of increasing the purge flow rate.

The fuel vapor sensor 38 employed in the present invention is preferably of the type known in the art as an "adsorption sensitive resistor". An adsorption sensitive resistor exhibits an electrical resistance that changes with respect to concentrations of various substances. An adsorption sensitive resistor operates on the principle of adsorption, the phenomenon which attracts and holds a molecule to the surface of a solid. The measure of this attractive force is known as the Vander Waals "a" constant for a specific molecule. When used to detect a vapor, the rapid process of gaseous diffusion carries gas molecules into contact with the adsorptive material in the adsorption sensitive resistor, thereby changing the its electrical characteristics.

Adsorption sensitive resistors are discussed in U.S. Pat. No. H454; U.S. Pat. No. 5,944,067; U.S. Pat. No. 5,913,343; U.S. Pat. No. 5,202,667; U.S. Pat. No. 4,935,726; U.S. Pat. No. 4,827,246; U.S. Pat. No. 4,237,721; U.S. Pat. No. 4,224,595; and U.S. Pat. No. 3,045,198, each of these issued U.S. patents being hereby expressly incorporated by reference herein.

A particularly preferred embodiment of the fuel vapor sensor 38 employed in the present invention is an adsorption sensitive resistor currently produced by Adsistor® Technology, Inc., presently of Seattle, Wash., USA (P.O. Box 51160, Seattle, Wash. 98115) and marketed by that company under the U.S. Registered Trademark of "Adsistor®". As shown in FIGS. 4–10 and discussed immediately below, the Adsistor®-type adsorption sensitive resistor produced by Adsistor® Technology, Inc. has exhibited, in laboratory tests, accurate monitoring of fuel vapor concentrations under normally expected conditions.

FIGS. 4–11 show the results of tests conducted under the SHED ("Sealed Housing Emissions Determination") standard published by the Society of Automotive Engineers ("SAE"). The charts in FIGS. 4–11 cover a range of canister capacities and a range of flow rates. As can be seen from the charts set forth in FIGS. 4–11, an adsorption sensitive resistor, most particularly the adsorption sensitive resistor marketed under the registered trademark of Adsistor® by Adsistor® Technology of Seattle, Wash., USA exhibits quite good tracking of the control fuel vapor concentration as measured under the SHED standard published by the SAE.

Figure 11:
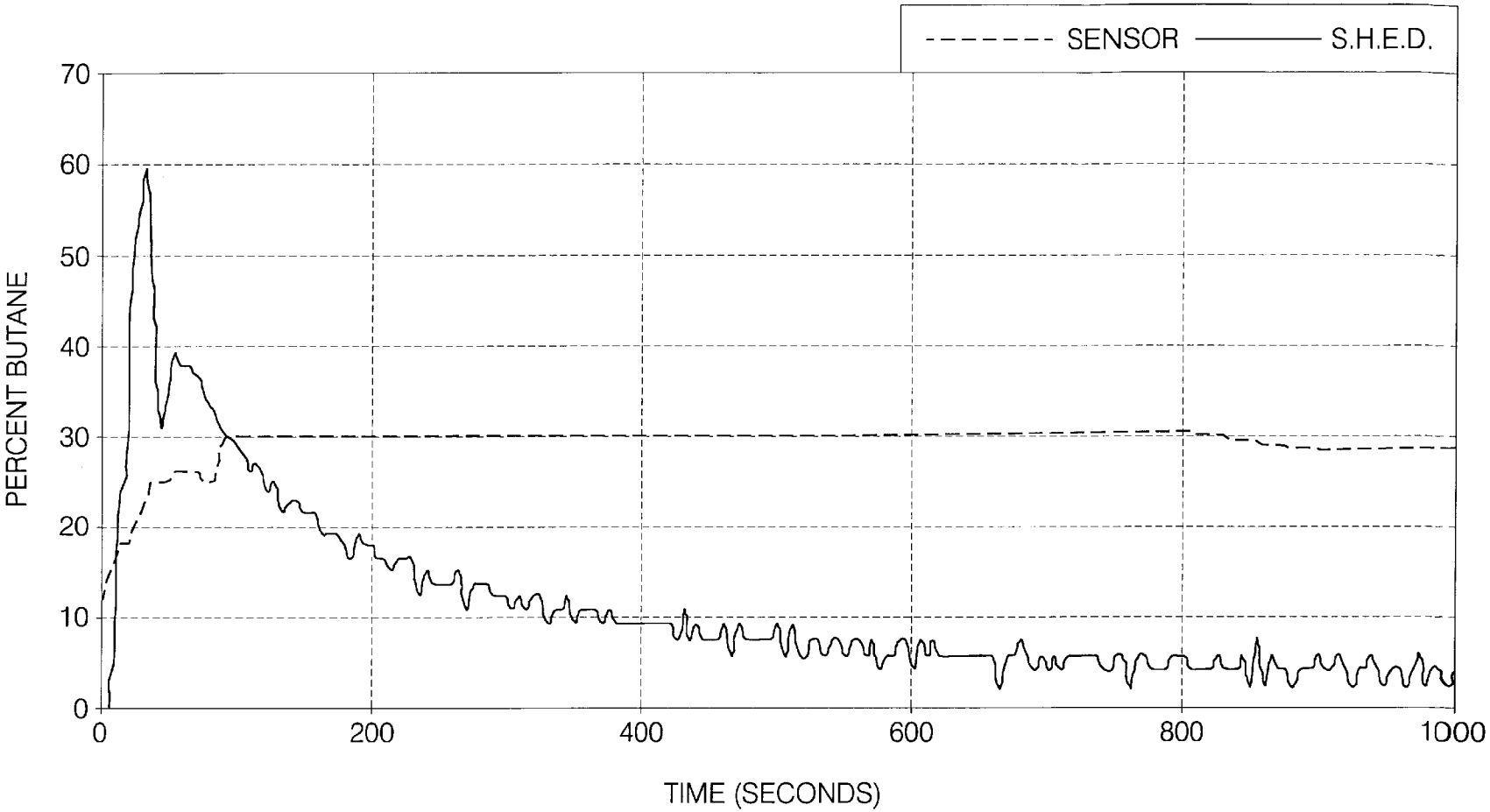

FIG. 11 is a chart showing measurements obtained using a "Figaro" sensor, well known in the art, as compared to the same SHED standard. It will be appreciated that the Figaro sensor does not exhibit the same degree of accuracy, as compared to the SHED standard, as an adsorption sensitive resistor. However, the present invention is not to be seen as limited to an adsorption sensitive resistor, such as the Adsistor®. Rather, the present invention is believed to have applicability to any fuel vapor sensor that may be reliably utilized to give real time readings of the fuel vapor content of the canister 12 so as to permit a more accurate control of the fuel vapor flow through the purge line 26 from the canister 12 to the engine 16.

While the present invention has been described by way of a detailed description of a number of particularly preferred embodiments, it will be readily apparent to those of ordinary skill in the art that various substitutions of equivalents may be effected without departing from the spirit or scope of the invention as set forth in the appended claims.

We claim:

1. A fuel vapor storage apparatus for reducing pollutant emissions from an internal combustion engine having a fuel tank, said fuel vapor storage apparatus comprising:

a fuel vapor storage canister for storing fuel vapor produced by evaporation of fuel stored in such fuel tank;

a purge line connecting said fuel vapor storage canister with such internal combustion engine;

a fresh air port connecting an interior portion of said fuel vapor storage canister with an ambient atmosphere of such internal combustion engine;

said interior portion of said fuel vapor storage canister being in substantially continual communication with such ambient atmosphere of such internal combustion engine through said fresh air port; and an adsorption sensitive resistor for determining a concentration of fuel vapor;

said adsorption sensitive resistor being mounted substantially within said fresh air port.

2. A fuel vapor storage apparatus according to claim 1, wherein an electrical resistance of said adsorption sensitive resistor varies in relationship to a concentration of such fuel vapor.

3. A fuel vapor storage apparatus according to claim 1, wherein said adsorption sensitive resistor comprises an Adsistor®-type sensor element.

4. A fuel vapor storage apparatus according to claim 1, wherein said internal combustion engine powers a vehicle.

5. A fuel vapor storage apparatus for reducing pollutant emissions from an internal combustion engine having a fuel tank, said fuel vapor storage apparatus comprising:

a fuel vapor storage canister for storing fuel vapor produced by evaporation of fuel stored in such fuel tank;

a purge line connecting said fuel vapor storage canister with such internal combustion engine;

a fresh air port connecting an interior portion of said fuel vapor storage canister with an ambient atmosphere of such internal combustion engine;

said interior portion of said fuel vapor storage canister being in substantially continual communication with such ambient atmosphere of such internal combustion engine through said fresh air port; and an adsorption sensitive resistor for determining a concentration of fuel vapor;

said adsorption sensitive resistor being mounted substantially within said purge line and immediately adjacent a junction of said purge line with said fuel vapor storage canister.

6. A fuel vapor storage apparatus according to claim 5, wherein an electrical resistance of said adsorption sensitive resistor varies in relationship to a concentration of such fuel vapor.

7. A fuel vapor storage apparatus according to claim 5, wherein said adsorption sensitive resistor comprises an Adsistor®-type sensor element.

8. A fuel vapor storage apparatus according to claim 5, wherein said internal combustion engine powers a vehicle.

9. A method for controlling the purging of a fuel vapor storage canister of an internal combustion engine, said internal combustion engine having a fuel tank, said fuel vapor storage canister being for the storage of fuel vapor produced by evaporation of fuel stored in said fuel tank, said fuel vapor storage canister including a purge line for purging fuel vapor from said fuel vapor storage canister to said internal combustion engine during said purging and a fresh air port for admitting ambient air into said fuel vapor canister from an ambient atmosphere of said internal combustion engine, said method comprising the steps of:

(a) maintaining an interior of said fuel vapor storage canister in substantially continuous communication with said ambient atmosphere of said internal combustion engine through said fresh air port;

(b) mounting an adsorption sensitive resistor substantially within said fresh air port;

(c) obtaining readings from said adsorption sensitive resistor indicative of a fuel vapor concentration existing substantially within said fresh air port; and (d) controlling a rate of flow of fuel vapor through said purge line from said fuel vapor storage canister to said internal combustion engine based upon said readings of said adsorption sensitive resistor obtained in said step (c).

10. A method for controlling the purging of a fuel vapor storage canister of an internal combustion engine according to claim 9, wherein an electrical resistance of said adsorption sensitive resistor varies in relationship to a concentration of such fuel vapor.

11. A method for controlling the purging of a fuel vapor storage canister of an internal combustion engine according to claim 9, wherein said adsorption sensitive resistor comprises an Adsistor®-type sensor element.

12. A method for controlling the purging of a fuel vapor storage canister of an internal combustion engine according to claim 9, wherein said internal combustion engine powers a vehicle.

13. A method for controlling the purging of a fuel vapor storage canister of an internal combustion engine, said internal combustion engine having a fuel tank, said fuel vapor storage canister being for the storage of fuel vapor produced by evaporation of fuel stored in said fuel tank, said fuel vapor storage canister including a purge line for purging fuel vapor from said fuel vapor storage canister to said internal combustion engine during said purging and a fresh air port for admitting ambient air into said fuel vapor canister from an ambient atmosphere of said internal combustion engine, said method comprising the steps of:

(a) maintaining an interior of said fuel vapor storage canister in substantially continuous communication with said ambient atmosphere of said internal combustion engine through said fresh air port;

(b) mounting an adsorption sensitive resistor substantially within said purge line and immediately adjacent a junction of said purge line with said fuel vapor storage canister;

(c) obtaining readings from said adsorption sensitive resistor indicative of a fuel vapor concentration existing substantially within said purge line substantially immediately adjacent said junction of said purge line with said fuel vapor storage canister; and (d) controlling a rate of flow of fuel vapor through said purge line from said fuel vapor storage canister to said internal combustion engine based upon said readings of said adsorption sensitive resistor obtained in said step (c).

14. A method for controlling the purging of a fuel vapor storage canister of an internal combustion engine according to claim 13, wherein an electrical resistance of said adsorption sensitive resistor varies in relationship to a concentration of such fuel vapor.

15. A method for controlling the purging of a fuel vapor storage canister of an internal combustion engine according to claim 13, wherein said adsorption sensitive resistor comprises an Adsistor®-type sensor element.

16. A method for controlling the purging of a fuel vapor storage canister of an internal combustion engine according to claim 13, wherein said internal combustion engine powers a vehicle.

* * * * *